United States Patent [19]

Schott

[11] 3,952,159

[45] Apr. 20, 1976

[54] DUCTED PORT REFLEX ENCLOSURE

[75] Inventor: Wayne M. Schott, Mount Prospect, Ill.

[73] Assignee: Zenith Radio Corporation, Chicago, Ill.

[22] Filed: Dec. 18, 1974

[21] Appl. No.: 533,903

Related U.S. Application Data

[63] Continuation of Ser. No. 339,815, March 9, 1973, abandoned.

[52] U.S. Cl. ..... 179/1 E; 181/156

[51] Int. Cl.[2] ..... H04R 1/02; G10K 11/00

[58] Field of Search ..... 179/1 E; 181/144, 156

[56] References Cited

UNITED STATES PATENTS

| | | | |
|---|---|---|---|
| 3,037,081 | 5/1962 | Carlsson | 179/1 E |
| 3,684,051 | 8/1972 | Hopkins | 181/199 |
| 3,688,864 | 9/1972 | Guss | 181/145 |

FOREIGN PATENTS OR APPLICATIONS

| | | | |
|---|---|---|---|
| 1,270,117 | 3/1965 | Germany | 179/1 E |

OTHER PUBLICATIONS

"Vented Loudspeaker Enclosures"by Planer & Boswell, Audio Engineering; May, 1948, pp. 29–30 & 43–45.

"Design For a Bass-Reflex Cabinet", by Youngmark, Audio Engineering, Sept., 1951, pp. 18, 19, 46, & 47.

"Handbook of Sound Reproduction", by Villchur, 1957, pp. 103–106.

*Primary Examiner*—Douglas W. Olms
*Attorney, Agent, or Firm*—Cornelius J. O'Connor

[57] ABSTRACT

In a bass-reflex sound reproducing system, a ducted port is utilized to reduce distortion in the lower portion of the frequency range. To increase relative sound pressure level in that lower portion, the enclosure is constructed to exhibit a predetermined acoustic compliance and is essentially air-tight except for a pair of primary openings. Mounted sealingly over one opening is the bass-range loudspeaker which exhibits a selected cone-suspension acoustic compliance, a given loaded free-air Q not less than 0.4, but not greater than 1.0 and a predetermined free-air resonant frequency. The ratio of the enclosure compliance to the cone compliance is no less than 0.707. The duct projects from around the periphery of the second opening and has its length and cross-sectional area such that it exhibits a tuned acoustic frequency the ratio of which to the speaker resonant frequency is not less than 0.5 and not greater than 1.0. Consequently, radiation through the duct is that of a frequency generally below that of the sound projected directly by the speaker, but is at a sound pressure level at least substantially equal to that of the sound projected directly by the speaker.

1 Claim, 5 Drawing Figures

FIG. 1
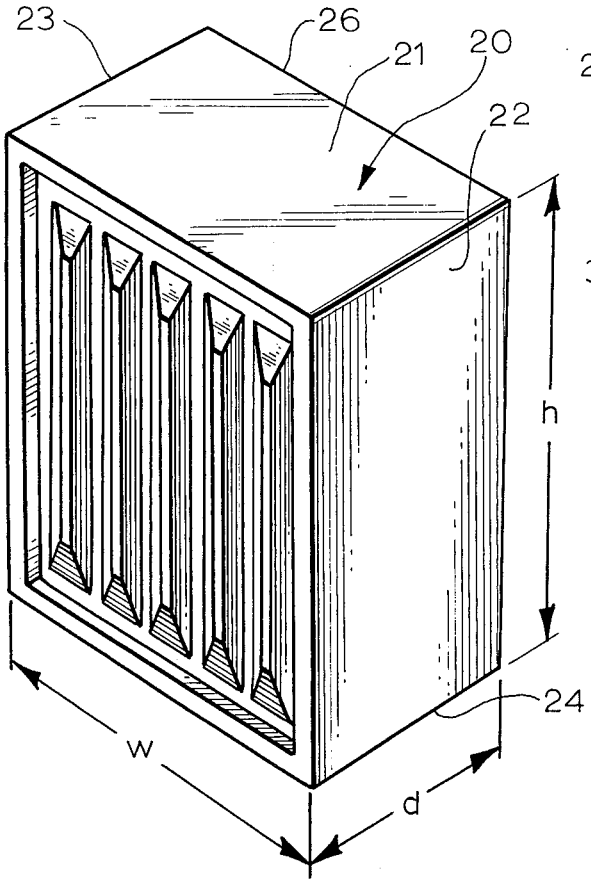
FIG. 2
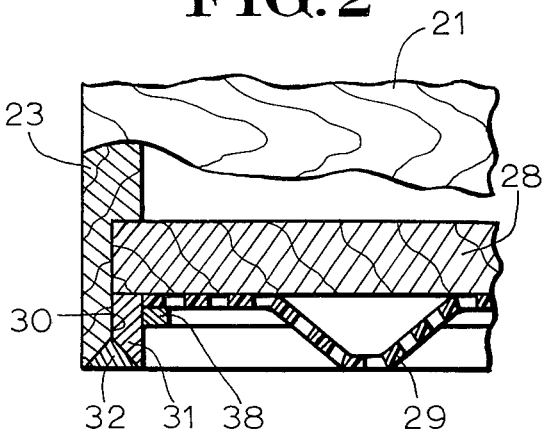
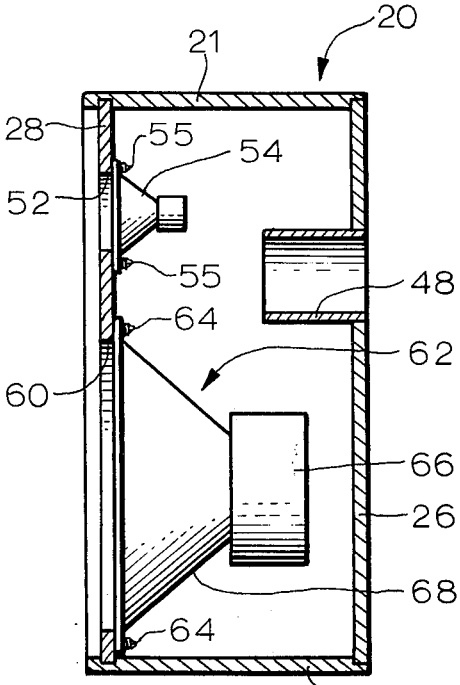
FIG. 4
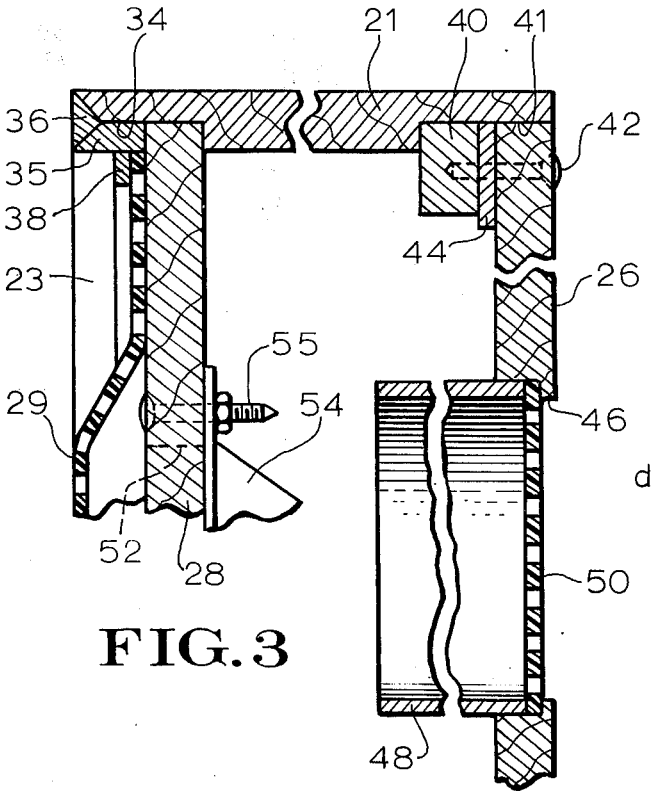
FIG. 3
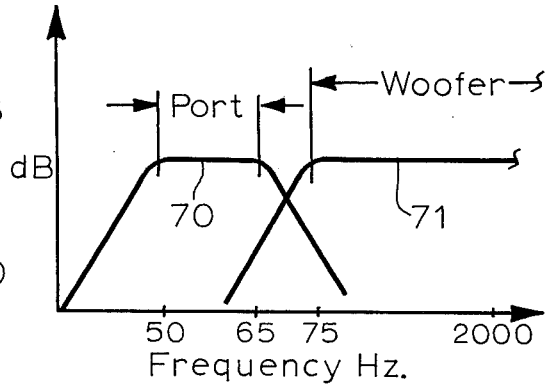
FIG. 5

DUCTED PORT REFLEX ENCLOSURE

CROSS-REFERENCE TO RELATED APPLICATION

This application is a continuation of my copending application Ser. No. 339,815, filed Mar. 9, 1973 now abandoned, entitled DUCTED PORT REFLEX ENCLOSURE, assigned to the same assignee as the present invention.

BACKGROUND OF THE INVENTION

The present invention pertains to a sound reproducing system. More particularly, it relates to a ducted-port bass-reflex loudspeaker arrangement.

For a long number of years, much effort has been devoted in attempts to improve the fidelity of sound systems employed particularly for the reproduction of recordings, broadcasts and live entertainment. In one area of this effort, a considerable amount of work has been expended, both empirically and theoretically, with an aim toward better low-frequency or bass response while yet avoiding the use of speaker systems which become so large as to be unwieldy and, in some cases, impractical. While important improvements have been made in this regard, it is still insisted in many quarters that truly faithful bass response cannot be obtained without utilizing a comparatively large diameter loudspeaker combined with a very much larger enclosure. Somewhat typifying the discussions in the literature is an article entitled "Wisdom and Witchcraft of Old Wives' Tales about Woofer Baffles" by J. R. Ashley and T. A. Saponas that appeared in the October 1970 issue of the *Journal of the Audio Engineering Society*, Volume 18, No. 5, pp. 524-529. Of similar import are an article entitled "Improvement in 'Air Suspension' Speaker Enclosures with Tube Venting" by P. B. Williams and J. F. Novak, commercially published by the Jensen Manufacturing Company, a division of the Muter Company of Chicago, Ill., and an article entitled "Performance of Enclosures for Low-Resonance, High-Compliance Loudspeakers" by J. F. Novak which appeared in I.R.E. Transactions on Audio for January-February, 1959, Volume AU-7, No. 1, at Pages 5–13. Also of interest is an article under the title "Loudspeakers in Vented Boxes" by A. N. Thiele that was published in the *Journal of the Audio Engineering Society*, Volume 19, for May-June, 1971.

One approach often mentioned in the foregoing and other publications involves the use a ducted-port bass-reflex enclosure for the loudspeaker. In that approach, the loudspeaker is mounted in an opening in a cabinet which is air-tight except for a second opening from which a tube or duct projects inwardly into the cabinet. It has been shown that use of the bass reflex principle enables the attainment of a three to four decibel increase in efficiency over the more conventional air-suspension closed-boxed type of enclosure. One possible way of designing this type of enclosure is described in an article entitled "Designing a Ducted-Port Bass-Reflex Enclosure" by James F. Novak, published in 1965 commercially by the aforementioned Jensen Manufacturing Division of the Muter Company.

At least usually, both the loudspeaker and the enclosure in prior ducted-port bass reflex systems have been tuned to approximately 30 hertz. The enclosure is quite small, perhaps between one and two cubic feet, and the loudspeaker has a comparatively light moving mass. The result is the combined production of a sound pressure level which increases generally from below 30 hertz to about 90 hertz beyond which the sound pressure level is comparatively constant throughout the low-frequency range. The purpose of the ducted port in these prior systems is to provide acoustical loading of the loudspeaker cone at low frequencies in an effort to reduce distortion. However, the output sound pressure level of such systems at the tuned frequency is generally between ten and eighteen decibels down from the sound pressure level over the higher frequencies in the bass region. That is, the loudspeaker itself is radiating efficiently at a certain pressure level only down to about 90 hertz, while the ducted port, although contributing to radiation of the sound at lower frequencies, is producing that lower-frequency sound only at a substantially reduced pressure level.

OBJECTS OF THE INVENTION

It is, accordingly, a general object of the present invention to provide a new and improved sound reproducing system which overcomes limitations and deficiencies mentioned above.

It is a specific object of the present invention to provide a new and improved ducted-port bass-reflex sound reproduction system.

Another object of the present invention is to provide a new and improved sound reproducing system in which, although using but a small enclosure, produces a substantial bass frequency response from a very low frequency through the bass range.

A further object of the present invention is to provide a new and improved ducted-port bass reflex sound reproducing system in which the pressure level of sound radiated from the ducted port is equal to or greater than that of the sound radiated from the loudspeaker.

SUMMARY OF THE INVENTION

The present invention thus relates to ducted-port bass-reflex sound reproducing systems wherein the ducted port is utilized to reduce distortion in the lower portion of the frequency range. In order to increase relatively the sound pressure level in that lower portion, the combination includes an enclosure that exhibits a predetermined acoustic compliance and is essentially air-tight except for a pair of primary openings. The first opening is located in one wall portion of the enclosure, while the second opening is located in another wall portion thereof spaced from the first. A bass-range loudspeaker is mounted on the first wall portion so as to air seal and project sound outwardly of the enclosure through the first opening. The loudspeaker exhibits a selected cone-suspension acoustic compliance together with a given loaded free-air Q not less than 0.4 and not greater than 1.0 and a predetermined free-air resonant frequency. The ratio of the enclosure compliance to that of the cone suspension is no less than 0.707. Projecting from around the periphery of the second opening is the duct. It has its length and cross sectional area selected such that it exhibits a tuned acoustic frequency the ratio of which to the resonant frequency of the loudspeaker is not less than 0.5 and not greater than 1.0.

BRIEF DESCRIPTION OF THE DRAWINGS

The features of this invention which are believed to be novel are set forth with particularity in the appended claims. The invention, together with further objects and advantages thereof, may best be understood, however, by reference to the following description taken in conjunction with the accompanying drawings, in the several figures of which like reference numerals identify like elements, and in which:

FIG. 1 is a perspective view of a loudspeaker enclosure;

FIG. 2 is a fragmentary plan view, partially broken away, showing the upper left-front (as viewed in FIG. 1) corner of the enclosure shown in FIG. 1;

FIG. 3 is a fragmentary cross-sectional view taken from the right side of the enclosure of FIG. 1 along a longitudinal and central plane;

FIG. 4 is a simplified longitudinal cross section otherwise taken like the view of FIG. 3; and FIG. 5 is a frequency response curve illustrating performance of the sound reproducing system of the earlier figures.

DESCRIPTION OF THE PREFERRED EMBODIMENT

In FIG. 1, an enclosure 20 includes a top panel 21, side panels 22 and 23 and a bottom panel 24. Also included is a back panel 26 and a front assembly better shown in FIG. 2 as including a front panel 28 and a decorative grill 29. Except for grill 29, all portions of the enclosure so far mentioned are formed of wood or an equivalent such as 40-pound minimum-density flakeboard. Moreover, all of these parts are securely glued or otherwise fastened together so as to form a cabinet which is air tight except for intended sound-radiating openings to be described. Thus, front panel or baffle 28 is fitted around its edges securely into recesses cut into the other panels with which it joins and is additionally locked into place by trim strips. Referring to FIG. 2, for example, the vertical edge of panel 28 fits into a recess 30 cut into panel 23. The balance of that recess is filled with a trim strip 31 except for a decorative molding 32 fitted over the front edge surface of panel 23. Similarly, and as shown in FIG. 3, the upper edge of panel 28 nest snuggly into a recess 34 cut into top panel 21. That portion of the assembly is completed by a trim strip 35 and a molding 36. The same mode of construction is employed along the bottom and the other side. Additionally, a metal trim piece 38 is in this case affixed around the outer periphery of grill 29 so as to rest against strips 31 and 35 and their counterparts along the other edges.

Since back panel 26 desirably is removable so as to permit installation or servicing of the speaker components, a mounting block 40 is rigidly secured around the rear, inner periphery of the cabinet. Thus, block 40 is seated in a recess 41 cut into top panel 21 as shown in FIG. 3. Back panel 26 then is tightly affixed to block 40 by means of screws 42. For the purpose of obtaining the air-tightness already mentioned, a ribbon 44 of a resilient material, such as polyurethane, is squeezed between block 40 and panel 26. Not only are the different portions of the enclosure secured rigidly together to be air-tight, but all of the panels are of sufficient thickness so as to be vibration-free when assembled.

A circular opening 46 is located along the vertical center line of rear panel 26. Projecting preferably inwardly into the cabinet or enclosure from around the periphery of opening 46 is a tubular duct 48 having its external end in this case covered by a perforated screen 50; if desired, duct 48 alternatively may project outwardly from the enclosure. Screen 50 is included at the outset simply for the purpose of blocking the insertion of very large objects or perhaps a child's hand into the enclosure. In principle, it may be deleted. When used, however, its presence is accounted for in selecting the dimensions of duct 48. In a practical embodiment, screen 50 is formed of a styrene sheet only 0.03 inch in thickness and perforated throughout so as to provide about 70 percent open area. Similarly, grill 29 serves essentially only as a feature of decoration. It likewise is perforated and exhibits about 60 percent open area. For convenience, it also is a thin sheet of a plastic material and in use preferably is covered with an attractive grill cloth. Duct or tube 48 is simply a length of spiral-formed paper tube.

For the purpose of further description, enclosure 20 has been simplified in FIG. 4 by omitting most of the trim and fastening details. As there depicted, however, front panel 28 includes a first opening 52 around which a high-frequency or treble-range loudspeaker 54 is sealingly mounted by screws 55 so as to project sound outwardly of the enclosure through opening 52. A second opening 60 in front panel 28 accommodates a bass-range loudspeaker or woofer 62 which is mounted over opening 60 by screws 64 again so as to form an air seal and project its sound outwardly of the enclosure through that opening. Although preferred, the smaller speaker 54 is optional and may be deleted from the enclosure; in that case, however, opening 52 then either must be deleted or sealingly covered. Alternatively, and as a modification of the illustrated disclosure, tube or duct 48 may project from an opening in any other wall of the enclosure, such as opening 52 formed in front panel 28. While not specifically shown, loudspeakers 54 and 62, are, of course, wired to connector terminals so as to permit their electrical energization without violating the air-tight sound pressure seal of the enclosure; to that end, connecting terminal screws may project through rear panel 26.

Loudspeaker 62 is, in itself, of conventional woofer-type construction. It includes an electromagnetic structure 66 within which is a moving coil that, in response to the field produced by the magnet, drives a sound producing cone 68 affixed at its inner or narrow end to the moving coil. In seeking to minimize enclosure size, loudspeaker 62 preferably is sufficiently large to occupy a substantial proportion of front panel 28. Thus, as in the present case wherein enclosure 20 has a volume of the order of 1 cubic foot, loudspeaker 62 is chosen to have a diameter of 10 inches.

More generally speaking, the arrangement herein illustrated and described is particularly applicable to sound reproduction systems wherein the diameter of duct 48 is between 2 and 6 inches and yet is effective to radiate acoustic energy at wavelengths greater than 10 feet; while the enclosure is less than 4 cubic feet in volume in the case where one speaker is employed (less than 8 cubic feet with a two speaker enclosure), a pressure level of sound radiated from duct 48 is obtained which is not less than 3db below the piston band level of loudspeaker 62. To that end, it is necessary to select particular values of the loaded Q of loudspeaker 62, the mass of its coil and cone and its free-air resonant frequency, while at the same time coordinating those values by appropriate tuning of the frequency of resonance of duct 48. To meet these critieria in a small enclosure having a comparatively large bass-range loudspeaker as already mentioned, it is necessary that the moving mass (cone and coil) of the loudspeaker be chosen to be exceptionally heavy. At the same time, the free air resonance of the loudspeaker is maintained at a relatively high value by appropriate selection of the cone suspension stiffness. Yet, the loudspeaker must exhibit a low electromechanical Q in order to be able to radiate a very-low-frequency acoustic signal from the small duct opening. This is achieved by employing a magnet structure of comparatively high efficiency.

The foregoing parameter requirements are satisfied by choosing the different components so that a few necessary relationships are met. First, the ratio of the compliance of enclosure 20 to the compliance of the cone suspension of loudspeaker 62 must be not less than 0.707. Conveniently, this requirement is satisfied by securing sound absorbing material to one or more interior wall surfaces of the enclosure in order to increase its effective acoustic compliance. Next, the loaded free air Q of loudspeaker 62 must be not less than 0.4 nor greater than 1.0. Finally, the ratio of the resonant frequency to which duct 48 is tuned to the free air resonant frequency of loudspeaker 62 must be not less than 0.5 nor greater than 1.0.

A sound reproducing system constructed as illustrated in the drawings has the enclosure panels formed of ½ inch thick material. Its external dimensions are a height *h* of 18.5 inches, a width *w* of 14.5 inches and a depth *d* of 9.5 inches with front panel 28 being recessed inwardly by 0.69 inch. The inner end of duct 48 is 3.75 inches from the exterior surface of back panel 26 and the internal diameter of duct 48 is 2.625 inch. Loudspeaker 62 is of 10 inch diameter at the front of its frame and the mass of its cone plus the voice coil is 47 grams. The free air frequency of resonance is 45 hertz, while its loaded free air Q is 0.419. The tuned frequency of duct 48 is 45 hertz. The cone-suspension mechanical compliance of loudspeaker 62 is $2.48 \times 10^{-4}$ Meters/Newton, while the mechanical compliance of enclosure of 20 is $2.34 \times 10^{-4}$ Meters/Newton. Loudspeaker 62 is mounted on the longitudinal center line of front panel 28 with its center being spaced 12 inches below the top of the enclosure. Duct 48 has its center spaced 6.19 inches below the top of the enclosure.

In operation, the system just described exhibits a frequency response as shown in FIG. 5 wherein the sound pressure level in decibels is measured along the abscissa and plotted logarithmically. The sound pressure level radiating from the port at the end of duct 48 is illustrated by a curve 70, while the sound pressure level radiating from loudspeaker or woofer 62 is represented by a curve 71. The ducted port thus radiates some sound almost from zero up to more than 75 hertz. At the same time, loudspeaker 62 radiates some sound from less than 65 hertz and has a substantially flat response from 75 hertz up to in excess of 2000 hertz. Ducted port 48 has a flat response from about 50 to 65 hertz. Using the convention of defining response as that portion of the curve or curves between the half-power points, those values three decibels down from the maximum, it will thus be seen that the frequency response of the ducted port extends from about 40 to 70 hertz, while the frequency response of loudspeaker 62 extends from 70 hertz on upwardly. Moreover, it will be observed in particular that the frequency response or sound pressure level of the ducted port is substantially matched to that of the woofer. If desired, the duct pressure level may even be higher than that from the woofer. In any event, the overall system response is quite substantial from a very low frequency throughout the bass-range.

While a single bass-range loudspeaker 62 has been shown sealingly mounted over opening 60 in front panel 28 of the enclosure, it is appreciated that two or more bass-range loudspeakers can be mounted upon panel 28 or, for that matter, upon any wall of the enclosure. Accordingly, if the speaker means comprises two or more units then it is only necessary, insofar as the invention is concerned, that the speakers collectively exhibit a cone-suspension compliance such that the ratio of the enclosure compliance to that of the cone-suspension is not less than 0.707 and that the loaded free-air Q of the speaker means is not less than 0.4 nor greater than 1.0. Finally, again as in the case of a single speaker, the ratio of the tuned acoustic frequency of the duct to the free-air resonant frequency of the speaker means is not to be less than 0.5 nor greater than 1.0.

While particular embodiments of the present invention have been described, it is apparent that changes and modifications may be made therein without departing from the invention in its broader aspects. The aim of the appended claims, therefore, is to cover all such changes and modifications as fall within the true spirit and scope of the invention.

What is claimed is:

1. In a ducted-port bass-reflex sound reproducing system wherein the ducted port is utilized to reduce distortion in the lower portion of the frequency range being reproduced, the combination which increases relative sound pressure level in that lower portion of said frequency range comprising:

an enclosure having a volume less than 4 cubic feet and exhibiting a predetermined acoustic compliance and being essentially air-tight except for a pair of primary openings, a first located in one wall portion and a second located in another wall portion thereof spaced from said one wall portion;

bass-range loudspeaker means mounted on said one wall portion to air-seal and project sound outwardly of said enclosure through said first opening, said loudspeaker means exhibiting a selected cone-suspension acoustic compliance such that the ratio of said enclosure predetermined compliance to said selected cone-suspension compliance is not less than 0.707, said loudspeaker means further exhibiting a given loaded free-air Q not less than 0.4 and not greater than 1.0 and also exhibiting a predetermined free-air resonant frequency and a frequency response in which the half-power point at one end of the response is established at a predetermined low frequency; and a tubular duct having a diameter between 2 and 6 inches projecting from around the periphery of said second opening and having an assigned length and cross-sectional area such that it exhibits a tuned acoustic frequency and a frequency response in which the response between its half-power points extends from at least said loudspeaker free-air resonant frequency to said predetermined low frequency of said loudspeaker response, the ratio of said tuned acoustic frequency to said predetermined resonant frequency of said loudspeaker means being not less than 0.5 and not greater than 1.0.

* * * * *